US007419422B1

(12) United States Patent
Mehrabi

(10) Patent No.: US 7,419,422 B1
(45) Date of Patent: Sep. 2, 2008

(54) ROTARY CUTTING HEAD

(76) Inventor: Mohsen Mehrabi, P.O. Box 612, Elberton, GA (US) 30635

( * ) Notice: Subject to any disclaimer, the term of this patent is extended or adjusted under 35 U.S.C. 154(b) by 181 days.

(21) Appl. No.: 11/545,302

(22) Filed: Oct. 9, 2006

(51) Int. Cl.
*B24B 7/22* (2006.01)

(52) U.S. Cl. ..... 451/41; 125/13.01

(58) Field of Classification Search ..... 451/352, 451/353, 358, 41, 542, 547; 125/13.01, 15, 125/3, 4, 38
See application file for complete search history.

(56) References Cited

U.S. PATENT DOCUMENTS

| | | | | | |
|---|---|---|---|---|---|
| 1,828,740 | A | * | 10/1931 | Legge | 451/543 |
| 2,440,051 | A | * | 4/1948 | Lind et al. | 241/73 |
| 2,735,244 | A | | 2/1956 | Brown | |
| 3,326,480 | A | | 6/1967 | Jones | |
| 3,376,673 | A | * | 4/1968 | Metzger et al. | 451/342 |
| 3,451,721 | A | * | 6/1969 | Speirs et al. | 299/39.8 |
| 3,612,611 | A | * | 10/1971 | Ellis | 299/39.4 |
| 3,745,719 | A | | 7/1973 | Oswald | |
| 4,125,228 | A | * | 11/1978 | Brewer | 241/243 |
| 4,597,225 | A | | 7/1986 | Toncelli et al. | |
| 4,706,899 | A | * | 11/1987 | Parker et al. | 241/73 |
| 4,841,623 | A | | 6/1989 | Rine | |
| 4,918,872 | A | | 4/1990 | Sato et al. | |
| 5,243,790 | A | | 9/1993 | Gagne | |
| 5,468,178 | A | | 11/1995 | Kitko et al. | |
| 5,474,239 | A | * | 12/1995 | Williams et al. | 241/73 |
| 5,567,503 | A | | 10/1996 | Sexton et al. | |
| 5,683,143 | A | | 11/1997 | Peterson et al. | |
| 5,927,264 | A | | 7/1999 | Worley | |
| 6,021,771 | A | | 2/2000 | Swan et al. | |
| D434,052 | S | | 11/2000 | Swan et al. | |
| 6,196,911 | B1 | | 3/2001 | Preston et al. | |
| D508,060 | S | | 8/2005 | Olsen et al. | |
| 6,926,583 | B2 | | 8/2005 | Nussbaumer et al. | |

* cited by examiner

*Primary Examiner*—Robert A. Rose
(74) *Attorney, Agent, or Firm*—McNair Law Firm, P.A.

(57) ABSTRACT

A cutting disk adapted to be mounted with a rotating shaft to form the cutting head of a cutting machine. The disk includes a plurality of plates each of generally oval shape which mount a diamond cutting element along a major radius thereof. Each disk includes a slot with an L-shaped support formed along a corner formed by a slot wall and the periphery of the disk. The generally rectangular shaped diamond cutting element is secured in the slot with first and second edges thereof exposed. The plurality of disks are arranged along the rotating shaft with the cavities forming a continuous helical groove about the cutting head. This arrangement provides that the diamond cutting elements are sequentially brought into contact with the work surface for only a short period and then separated therefrom, thereby allowing the diamond cutting elements to cool between engagements.

4 Claims, 3 Drawing Sheets

ROTARY CUTTING HEAD

BACKGROUND OF THE INVENTION

The instant invention is directed to a cutting head formed of a plurality of disks secured with a rotating shaft of a cutting machine. The cutting head is primarily used in combination with a cuffing machine to remove paint and other residue from concrete, ceramic or stone floors. The cutting machine also removes indentations or crevices, closes the pores in the flooring and produces an even roughened surface. The device may be used to simply prepare stone or concrete to have an even roughened surface with closed pores.

Grinding and cuffing instruments are known in the industry such as the arrangements disclosed in U.S. Pat. Nos. 4,597,225 and 5,468,178. These arrangements are improved upon by the instant invention.

It is a primary object of the instant invention to provide a cutting head which is both efficient and durable.

Another object of the invention is an oval shaped cutting disk which carries, in a secure manner, one or more diamond cuffing members.

Another object of the invention is a carrier for supporting and rotating a plurality of disks in fixed radial positions.

Another object of the invention is a cuffing head which provides cooling for the diamond cutting elements during operation.

Another object of the invention is a cutting head in which the cutting elements of adjacent cuffing disk sequentially move through the cutting position.

Another object of the invention is the provision of an oval shaped disk shaped to mount a diamond cutting element at selected major axis points about its periphery.

SUMMARY OF THE INVENTION

A head which is adapted to be mounted with a cutting machine. The head includes a plurality of disks each of which supports at least one diamond cutting element adjacent its outer surface. Each disk includes a slot through its peripheral surface, including an L-shaped support area. A generally rectangular shaped diamond cutting element is secured in the slot with first and second edges being exposed.

The head, when secured with a cutting machine, presents a first of the exposed edges in the direction of rotation of the head.

Each head includes a plurality of disks with each disk carrying at least one diamond cutting element.

The disks are shaped to be oval or elliptical with at least one slot formed through an area of the major radius with a diamond cutting element in each slot. The disks are arranged along a shaft with the slots positioned to form a helical groove over the periphery of the head.

The diamond cutting elements are positioned along an upper edge of each slot to face in the direction of rotation. The oval shape, in combination with the location of the slot and the helical groove, causes the diamond cutting elements to be spaced from the work surface a majority of each revolution of the cutting head.

The cutting head is adapted to be mounted on a cutting machine which is operative to rotatably drive the cutting head at adjusted vertical positions as it is moved over the work surface.

DESCRIPTION OF A PREFERRED EMBODIMENT

Referring now in more detail to the drawings, the invention will now be described in more detail.

In industry, it has been found that floors in manufacturing or machine shops which are formed of concrete or other ceramic materials and have been painted, tend to become hard to clean after extended use because of residue build-up and because the paint cracks and peels. Similarly, these same type floors which have not been painted, due to build-up of waste products and dirt, also are hard to clean. Further, in both instances, these floors tend to absorb rather than reflect light which reduces the light in the work place and may create hazardous or unsafe work conditions.

It has been found that when removing the paint and/or dirt and residue by cutting the surface of the floor, a brighter, more light reflective surface which is free of crevices, valleys and cracks is produced. Also, the cutting operation closes the pores of the flooring material on its surface. This surface may be sealed with a known clear sealer. The result is a highly reflective and easily maintained flooring surface.

The cutting head of the invention has as its primary function cutting and stripping floors for the purpose of providing an even scored surface. The cutting head may be used for other purposes and with other materials such as finishing surfaces on stone, marble or other ceramic products.

Grinding and cutting machines are known as illustrated by co-pending application Ser. No. 11/396,765, filed Apr. 3, 2006. These devices are structured so that the diamond cutting and grinding element is always in contact with the work surface. This arrangement does not allow the diamond cutting and grinding element to cool during operation which causes excessive wear and breakdown of the diamond cutting grinding element.

Figure 1:
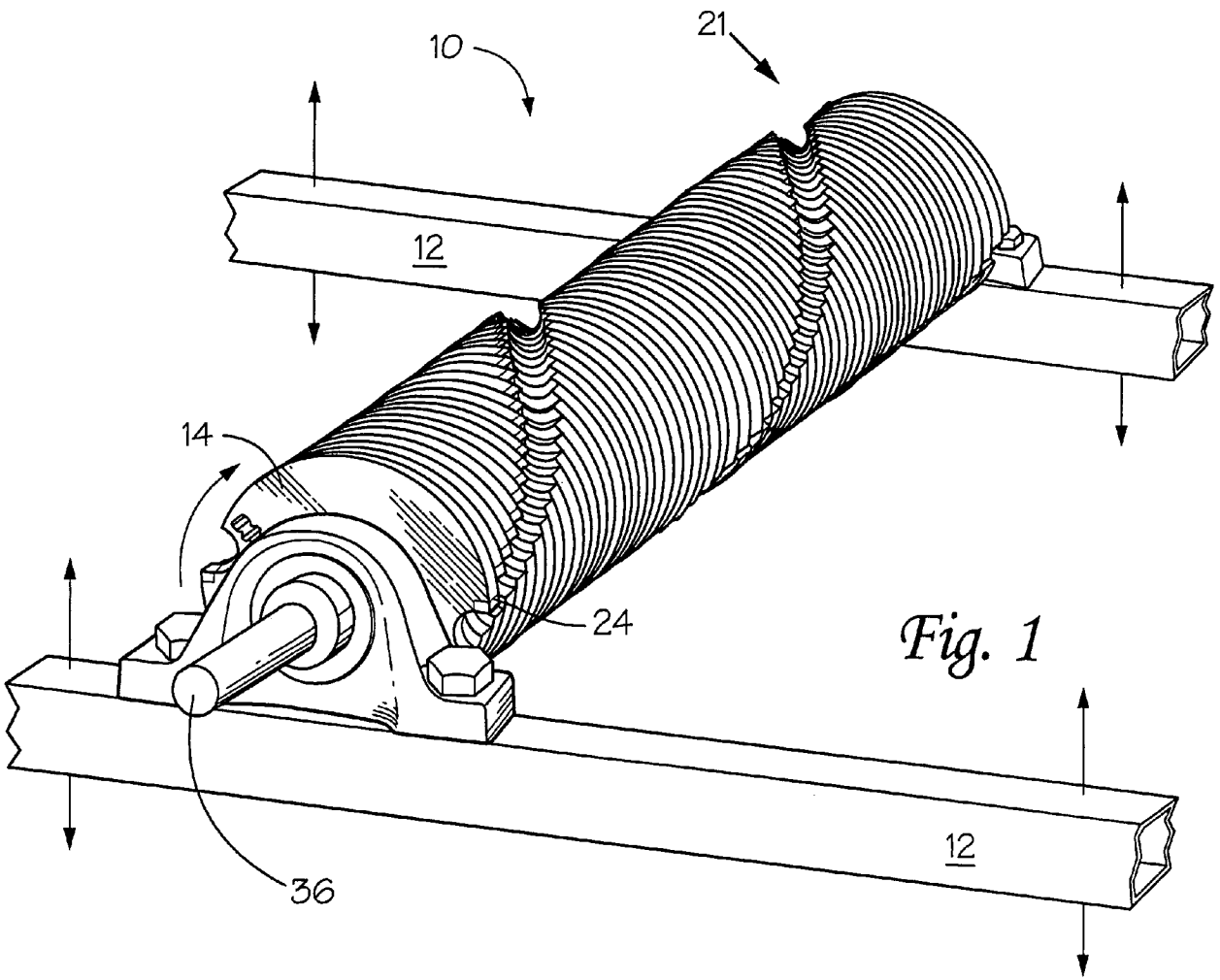
FIG. 1 is a perspective view of the cutting head mounted on the support members of a cutting machine.
Figure 2:
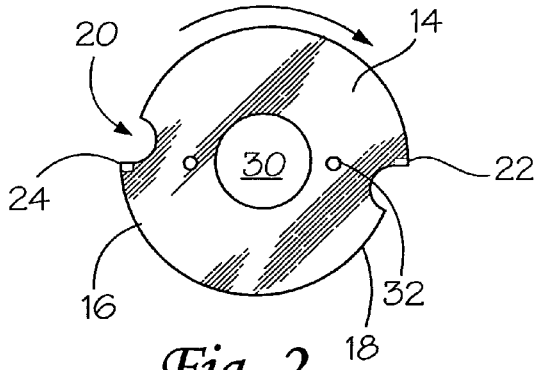
FIG. 2 is a side view of the cutting disk of the invention.

Turning now to FIG. 1, there is shown cutting head 10 of the invention mounted on frame members 12 of a cutting machine (not illustrated). Cutting head 10 comprises a plurality of oval shaped disk 14, preferably made of steel at about ¼" thick with a major radius 16 of between 3 and 5 inches and a minor radius 18 of about ¼" less than the major radius. Disks 14 are arranged in fixed side-by-side positions along shaft 36 forming cutting head 10 at a desired width. Each disk preferably includes a pair of opposed slots 20 formed at generally the intersection of the major and minor axes 16, 18. Of course, there may be more or less slots formed depending on the size of the disk and the requirements of the grinding machine. The slots must always be equally spaced from each other.

The slots radially extend into the disk for about 1 or ½" from the major radius 16. At the corner formed by the inner face of each slot and the disk periphery adjacent the major axis 16 is formed an L-shaped support area or notch 22 having a first face generally perpendicular with the axis of rotation and a second face generally parallel with the axis of rotation. The second face of L-shaped support is about but slightly less than ⅜" in length while the first face is about but slightly less than ¼" in length.

A multi-component or composite diamond cutting and grinding element 24, which consists of a poly-crystal diamond cutting face 26 or element laminated onto a body section 28 of tungsten carbide. The diamond cutting element is preferably ¼"×¼"×¼" with the poly-crystal diamond being only about 1 mm in thickness. Of course, the size of the diamond cutting element is also variable as desired.

The diamond cutting and grinding elements are commercially available and form no part of this invention. The diamond cutting and grinding elements 24 may be purchased from the following companies; DeBeers of South Africa, GE in the United States of America, Eljik in Korea and Dove in India.

Diamond cutting elements 24 may be secured in supports or notches 22 by epoxy or other suitable adhesives or they may be secured by brazing, preferably with a silver alloy. The diamond cutting face 26 is aligned generally with the wall of slot 20 while its upper surface, along with the upper surface of body section 28, is aligned generally with the peripheral surface of disk 14. In certain instances, the upper surface of cutting element 24 to include the diamond cutting face 26 may be arranged to extend slightly outward of the peripheral surface of disk 14 to accommodate wear of the poly-crystal diamond before wear begins on the peripheral surface of the disk.

Figure 3:
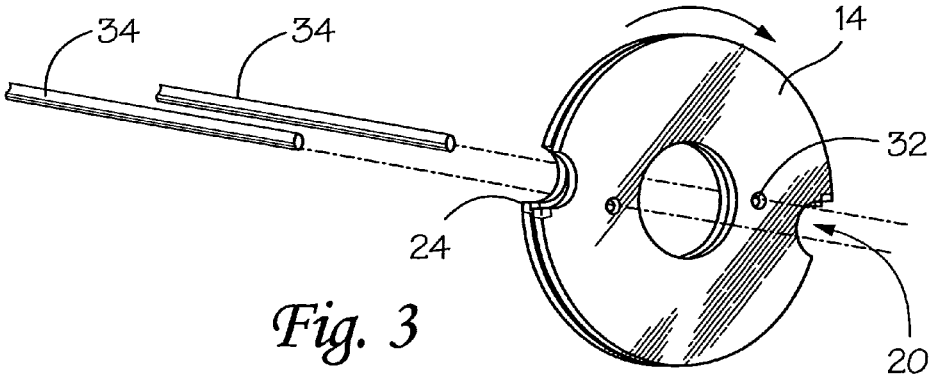
FIG. 3 is a perspective view of a pair of the cutting disk as positioned along the support shaft.
Figure 4:
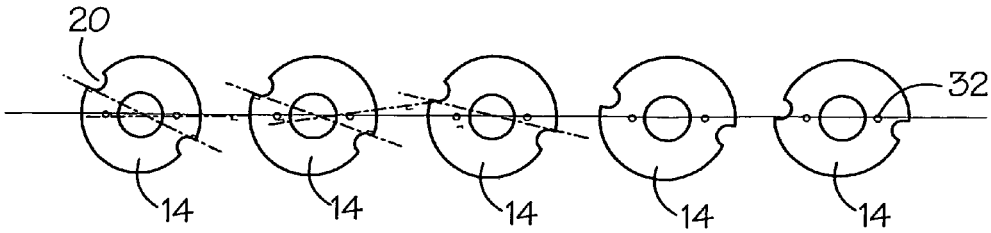
FIG. 4 is a diagrammatic side view of the cutting disk shown in progressive positions.

Each disk 14 includes a central bore 30 and a pair of spaced bores 32. Bores 32 are opposed each other and are equally spaced from bore 30. Bore pairs 32 are arranged in stepped sequence about the axis of bore 30 in adjacent of disk 14 as arranged along shaft 36. (See FIGS. 1, 3, and 4.) This arrangement places slots 20 along a helical path about the periphery of cutting head 10. Slots 20 form a continuous helical groove 21 across the length of cutting head 10. Rods 34, pass through bores 30 locking respective disk 14 in selected radial positions about shaft 32.

By locating disks 14 so that slots 20 form helical cavity or groove 21 about the periphery of cutting head 10 and by constructing each of the disk 12 to be generally oval shaped with the diamond cutting elements located at generally the major radius of each disk and along the rear wall of each slot, a cooling system is provided which prevents the diamond cutting elements from over-heating and prematurely wearing during cutting.

Figure 5:
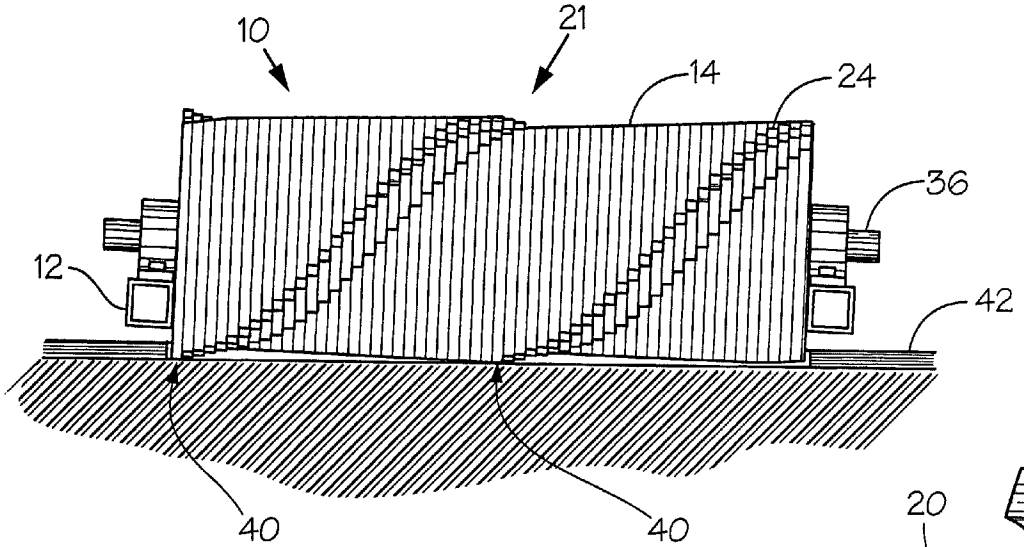
FIG. 5 is a front view of the cutting head of the invention.
Figure 6:
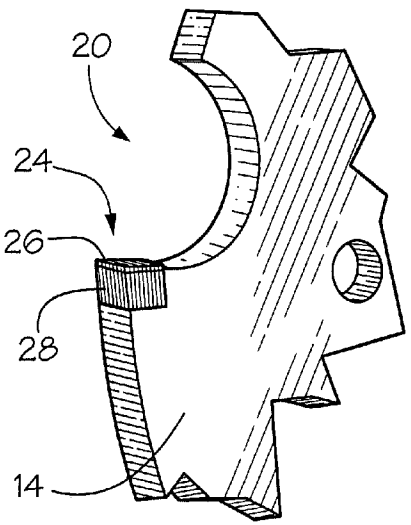
FIG. 6 is a perspective sectional view of the diamond cutting element mounted with the cutting disk.

Turning to FIG. 5, a front view showing cutting head 16 in operation with only the sections indicated at 40 being in actual contact with work surface 42 while all other areas are spaced from the work surface. As head 16 continues to rotate the diamond cutting elements 24 are sequentially brought into contact with work surface 42 while those last contacting the work surfaces are rotated into the cooling position. This arrangement provides superior cutting and grinding of the work surface removing paint, dirt or other undesirable material covering the work surfaces, providing a cleared and textured surface, while simultaneously extending the life of the cutting head.

While a preferred embodiment of the invention has been described using specific terms, such description is for illustrative purposes only, and it is to be understood that changes and variations may be made without departing from the spirit or scope of the following claims.

What is claimed is:

1. A rotatable cutting head for use with a cutting machine for stripping or finishing stone and concrete surfaces comprising:

a plurality of cutting disks each with at least one slot having opposed generally radially extending surfaces of different length and a generally elliptical outer surface, the longer of said radial surfaces having a generally "L" shaped notch in an upper edge;

said disks being arranged along a longitudinal axis in side-by-side positions with said slots being radially positioned about said axis forming said cutting head with a helically shaped groove along its length;

generally rectangular shaped composite cutting elements having a first surface formed of poly-crystal diamond and a second surface formed of tungsten carbide and poly-crystal diamond secured in each said notch by brazing and presenting a first face formed of said poly-crystal diamond extending generally parallel of said longer radial surface forming a cutting surface and a second face formed of said poly-crystal diamond and said tungsten carbide directed outwardly;

each said disk including a central opening for mounting with a support shaft and at least one bore spaced from said central opening in varying circumferential positions about said axis, said bores acting to radially position said disk about said shaft forming said helically shaped groove; wherein rotation of said cutting head sequentially brings said poly-crystal diamond faces into and out of engagement with a work surface being ground.

2. The cutting head of claim 1 wherein each said disk includes a plurality of slots, each including a diamond cutting element.

3. The cutting device of claim 1 wherein a second face of said diamond cutting member is located slightly above the periphery of said disk.

4. The cutting device of claim 1 wherein said diamond cutting member is approximately ¼"×¼"×¼".

* * * * *